United States Patent [19]

Khan

[11] 4,016,608

[45] Apr. 12, 1977

[54] SNAP FASTENERS FOR DROP-IN ASSEMBLIES

[75] Inventor: Aman Ullah Khan, Stevensville, Mich.

[73] Assignee: Whirlpool Corporation, St. Joseph, Mich.

[22] Filed: Sept. 30, 1974

[21] Appl. No.: 510,397

[52] U.S. Cl. ..... 4/187 A; 312/228

[51] Int. Cl.² ..... E03C 1/18

[58] Field of Search ..... 4/68, 166, 167, 170, 4/187 A; 312/228, 229

[56] References Cited

UNITED STATES PATENTS

| | | | |
|---|---|---|---|
| 597,503 | 1/1898 | Lanahan | 4/170 |
| 696,422 | 4/1902 | Duffy | 4/170 |
| 2,836,831 | 6/1958 | Hurwitz | 4/170 X |
| 2,938,218 | 5/1960 | Stone | 4/187 A |
| 3,034,144 | 5/1962 | Lyon | 4/187 A |
| 3,056,971 | 10/1962 | Hornik | 4/187 A |
| 3,128,479 | 4/1964 | Juergens | 4/187 A |

*Primary Examiner*—Richard E. Aegerter
*Assistant Examiner*—Frederick R. Schmidt
*Attorney, Agent, or Firm*—Hill, Gross, Simpson, Van Santen, Steadman, Chiara & Simpson

[57] ABSTRACT

Shaped springs are fitted to a flange of a modular package such as a sink-disposer unit inserted through an aperture in a surface. One camming surface moves each spring out of the way during insertion of the package into the aperture and a second camming surface sprung outwardly against the wall of the aperture to obstruct removal of the package as insertion is completed. The spring may then be selectively tensioned by a threaded nut.

4 Claims, 6 Drawing Figures

Fig-1
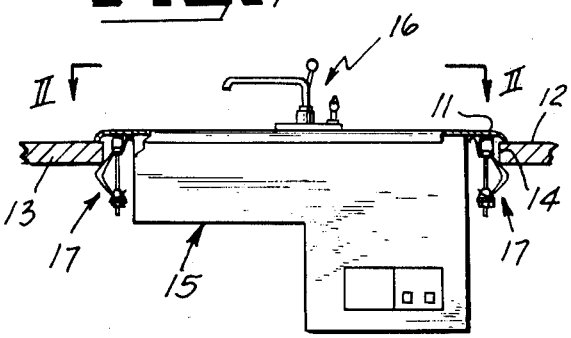
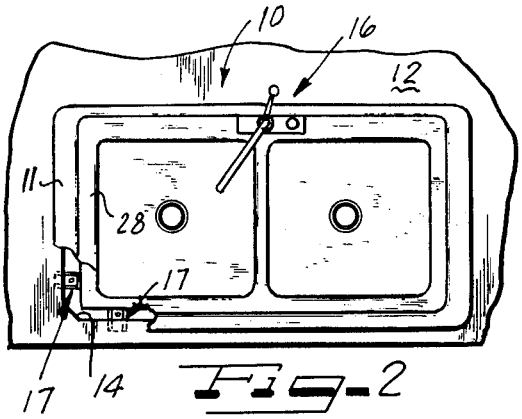
Fig-2
Fig-3
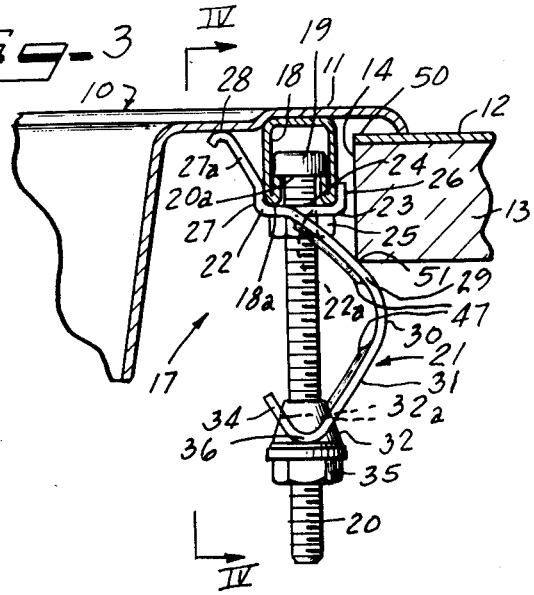
Fig-4
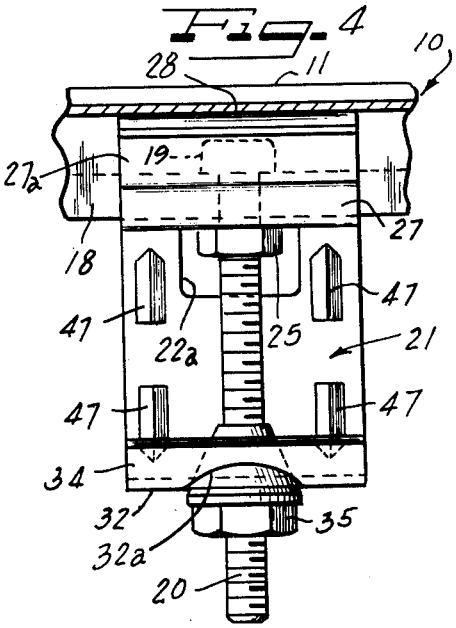
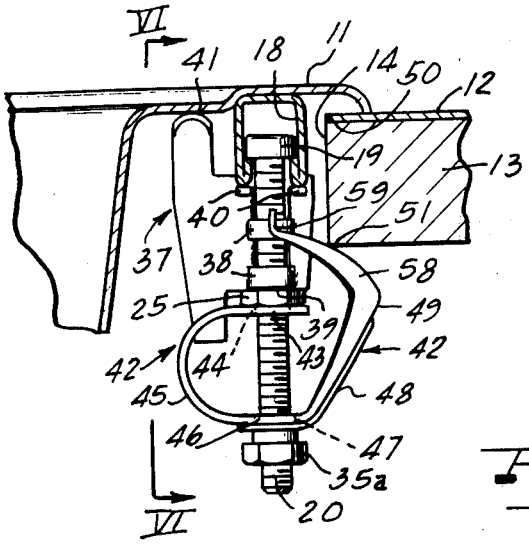
Fig-5
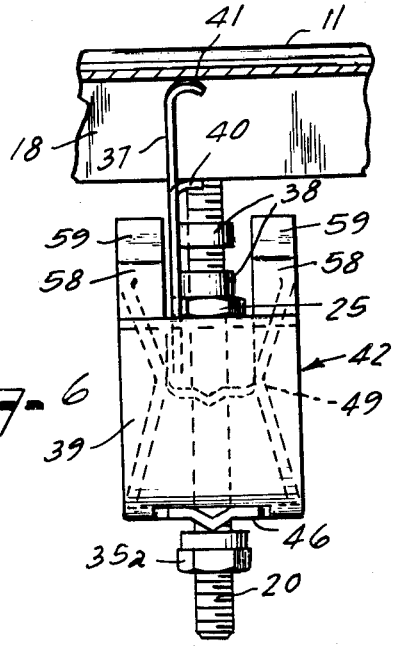
Fig-6

SNAP FASTENERS FOR DROP-IN ASSEMBLIES

BACKGROUND OF THE INVENTION

1. Field of the Invention

This invention relates to improvements in fittings used to lock modular packages such as sinks into apertures and surfaces provided by counter tops or other utilization frameworks.

2. Description of the Prior Art

Prior art devices commonly use relatively rigid fasteners to secure devices such as kitchen sinks into surfaces such as counter tops. J-bolts are fitted into eyes beneath a sink flange and threaded to receive nuts which may be tightened after insertion to engage the lower surface of the counter top, either directly or by means of a cooperating pivoted bar. Such prior art devices require assembly of parts under and behind an installation and require relatively much time and effort to effect a firm connection of the sink and other package to the counter top or other surface.

SUMMARY OF THE INVENTION

In accordance with the present invention a threaded stud is received in an inverted U-shaped channel inwardly of the edge of a flange surrounding the upper or outer portion of a package to be installed through an aperture in a surface, for example, a sink-disposer module in a counter top. A spring clamp is captured by a nut received on the threaded stud. The spring clamp has first and second cam surfaces extending outwardly from the package and under the flange a distance sufficient to engage the wall of the aperture in the surface to which the package is to be joined, i.e., in interfering registry, with the edges of the opening.

A second nut may be threaded to the end of the stud beneath the free end of the spring clamp to selectively adjust the tension if necessary or desirable. A sufficient number of clamps are disposed about the periphery of the unit to be installed in the U-shaped channel as aforesaid to effect a secure and rigid installation. Each of the spring clamps is cammed inwardly of the wall of the aperture in the receiving surface during such insertion, but each clamp will spring outwardly to engage the lower edge of said aperture in the surface once the package has been inserted a sufficient distance. The spring cams will then obstruct any attempted removal of the package from the aperture by the force of the spring cam on the lower edge of the aperture. A firmer connection may be had by forcing the second threaded nut against the lower surface of the cam after installation.

BRIEF DESCRIPTION OF THE DRAWINGS

FIG. 1 is a view partially in cross section of a kitchen sink and garbage disposer module unit mounted in a counter top showing use of the invention about the periphery of the module to engage the walls of the aperture in the counter top.

FIG. 2 is a top view of the sink in FIG. 1 with one corner cut away to show the use of the invention.

FIG. 3 is an enlarged view partially in cross section of a kitchen sink and counter top secured together by a clamp unit embodying the principals of the invention.

FIG. 4 is a view taken on line IV—IV of FIG. 3.

FIG. 5 is a view similar to FIG. 3 but showing a clamp unit of the present invention embodying a form somewhat modified from the form of FIG. 3.

FIG. 6 is a view taken on line VI—VI of FIG. 5.

DESCRIPTION OF THE PREFERRED EMBODIMENTS

It is frequently desirable to install modular units in the cabinetry of kitchens. For example, a typical modular package may include a sink, a food waste disposer, and all plumbing and electrical connections therefor. Such a construction is shown in partial cross section in FIG. 1, where a module 10 has a sink flange 11 which when installed rests upon an upper surface 12 of a counter top 13 outwardly adjacent a vertical aperture wall 14 through the working surface of the counter top. Such modules are readily installed by lowering the unit downwardly between the aperture walls 14 until the lower surface of the flange 11 contacts the upper surface 12 of the counter top 13 and thereby supports the unit 10 in suspension.

Water drainage and food waste disposal devices 15 may be located in the lower portion of the module 10 and hot and cold water connections can be made to the faucet and spray spigot 16.

In accordance with this invention a specific form of retainer device is shown generally at 17 in FIGS. 1 and 2 and in enlarged detail in FIGS. 3 and 4. An inverted U-shaped channel 18 is attached to the lower surface of the sink flange 11 inwardly of the outer edge thereof sufficient to allow clearance for wall 14 in the aperture of the counter top 13. The head 19 of an externally threaded stud is received within the channel 18 and a plurality of such studs 20 are disposed in spaced array at various places around the periphery of the sink 10 as shown in FIGS. 1 and 2. The edges of the head **20*a* overlie an inwardly reversely turned flange 18*a* formed on each side of the channel 18. A spring clamp 21 is formed from flat spring material as shown in FIGS. 3 and 4. In its final shape, the spring clamp is generally C shaped when viewed in the orientation of FIG. 3. The spring clamp 21 has a substantially horizontal portion 22 with a tab portion 23 cut or partially struck out from the main body of the spring 21 to form a horizontal support 24 which underlies the channel 18. A nut 25 is threadedly engaged with corresponding threads on the stud 20 and is screwed up the shaft of the stud 20 to engage the underside of support 24 thereby to capture spring clamp 21 between the nut 25 and flange 18*a* of the channel 18. An upwardly-extending flange 26 on the free end of tab portion 23 engages the lower outer abutment portion 18*b* of the channel 18. The flange 26 in cooperation with a vertical portion 27 of spring clamp 21 serves to align the spring clamp assembly in a position perpendicular to the edge of the sink flange 11, and to confine channel 18 against opening to release head 19 of stud 20**.

The vertical portion 27 joins an angled leg **27*a* extending generally upwardly and outwardly and terminating in a generally rounded abutment surface 28 which engages the lower surface of a sink or other member of the module 10 inwardly of the flange 11 to further assist in the alignment and rigid support of the spring clamp 21 against twisting forces on the spring clamp 21**.

A body portion of the spring clamp 21 lies below the horizontal portion 22 and consists of a camming leg 29 extending downwardly and laterally outwardly to a medially disposed knee or nose 30. A camming leg is then reversely turned to extend generally downwardly and laterally inwardly towards the axis of the stud 20.

The leg 31 terminates in a foot portion 32 which is reversely turned to form a surface 36 adapted to engage a nut threaded on the stud 20. An upwardly extending flange 34 completes the spring clamp as shown in FIG. 3. The lateral displacement of the nose or knee 30 of the spring clamp 21 is sufficient to dispose the camming legs in interfering registration with the edges of the opening prescribed by the aperture walls 14. Reinforcing notches 47 are embossed in the cam legs 29, 31 to improve selectively the strength and rigidity of the clamp. A pair of apertures are formed in the horizontal leg 22 as at 22*a* and in the foot 32 as at 32*a* to provide clearance for stud 20 and nut 25.

In installation, a plurality of studs 20 are inserted into the channels 18 in spaced relation about the periphery of the module 10. A spring clamp 21 is inserted over each stud and a nut 25 is employed to secure each stud 20 and clamp 21 to the channel 18. A cone nut 35 is then screwed onto the end of each stud 20 a short distance so as not to interfere with movement of the spring clamp foot 32.

As the module is lowered into the aperture 14 in the counter top 13, the cam leg 31 engages an upper edge 50 of the aperture, thereby camming the clamp 21 so that the nose or knee 30 slidingly engages the interior wall 14 of the aperture. As the nose 30 moves past a lower edge 51 of the aperture in the counter top, the camming leg 29 will underlie the lower edge 51, thereby resiliently clamping the module to the counter top.

When the module is fully inserted, the flange 11 engages the surface 12 and supports the weight of the unit while the cam leg 29 applies a resilient clamping bias resisting removal of the unit in the opposite direction. Insertion of the module is thereby permitted but removal obstructed.

The module may be more permanently attached to the surface by locking the spring clamp 21 against inward deflection by screwing the cone nut 35 into the opening 32*a* in the lower end 32 of the spring clamp 21 as shown in FIGS. 3 and 4.

Another form of the invention is shown in FIG. 5. Like reference numerals identify like parts. A sink 10 has a channel 18 inwardly of a supporting flange 11 as previously, and a similar stud 20 with a head 19 is received in the channel 18.

In this form of the invention, the nut 25 captures a separate thrust bracket 37 rather than the spring clamp. The thrust bracket 37 has a pair of axially spaced cut-outs 38, 38 which are offset relative to the main body of the bracket 37 and together therewith are shaped and formed to provide a bore in which is received the stud 20. The lowermost cut-out 38 provides with the bracket 37 an abutment surface 39 against which the nut 25 bottoms.

A pair of tabs 40, 40 are struck out from the bracket 37 and are disposed to underlie the edges of the channel 18. An upwardly extending arm of the bracket 37 terminates in a curved finger 41 which engages the sink 10.

The spring clamp is shown generally at 42 and comprises a first horizontal leg 43 apertured as at 44 to receive the stud 20. A semi-circular curved bight portion 45 extends from the leg 43 to a second horizontal leg 46 spaced from and parallel to the leg 43. The leg 46 is also apertured as at 47 to pass the stud 20.

A first camming leg is shown at 48 and extends upwardly and laterally outwardly relative to the axis of said stud terminating at a knee 49. The clamp is then bifurcated to form a pair of camming legs 58, 58 which extend away from the knee 49 in an upward and inward direction relative to the stud axis. The legs 58, 58 each terminate in an offset finger 59, 59. The clamp 42 may be embossed to form such additional strengthening ribs as are desired. A nut 35*a* is threaded onto the stud 20 and can be turned against the leg 46 to increase the resilient resistance of the clamp.

In operation, when the unit is dropped into place the leg 48 will engage the edge 50 and will cam the clamp inwardly, the bifurcated legs 58, 58 clearing the stud 20 and bracket 37 on opposite sides thereof. As the knee 49 passes the lower edge 51, the legs 58, 58 will underlie the edge 51 and the counter top 12 will be clamped resiliently and securely.

It will be understood that while I have described the invention as applied to a sink-disposer module, the principles of the present invention are applicable to other modular units and appliances as well, such as stoves.

Although various modifications might be suggested by those versed in the art, it should be understood that I wish to embody within the scope of the patent warranted hereon all such modifications as reasonably and properly come within the scope of my contribution to the art.

Having described the invention, the embodiments of the invention in which an exclusive property or privilege is claimed are defined as follows:

1. In a module construction having wall means forming an aperture and a modular package for insertion into said aperture, retainer means which allow insertion of said package into said aperture and retain said package against said wall means after said insertion, said retainer means comprising:

a support means adapted to be connected to the package;

stud means engaging said support means and extending downwardly therefrom;

a spring cam;

connection means connecting said spring cam to said stud and said support means;

said spring cam comprising first and second camming surfaces inclined relative to one another and a curved knee portion joining said first and second camming surfaces said first camming surface acting against said wall means to move said spring cam to an unobstructing position to allow said insertion, and said second camming surface acting against said wall means to obstruct removal of said package after insertion and thereby retain said package in said aperture; and an alignment means extending from said spring cam and said stud means beyond said support means to engage against a surface of said package.

2. In a module construction as defined in claim 1, said retainer means being further characterized by said spring cam having a free end opposite a portion of said spring cam connected to said stud and support means, said free end being movable in response to the engagement of said first and second cam surfaces with said wall means during insertion and being secured to said stud means after insertion to lock said second cam surface against said wall means.

3. In a module construction as defined in claim 1, said retainer means being characterized by said spring cam having a clamp portion and the connection means engaging said clamp portion and comprising first and second variably spaceable members carried on said stud, and said spring cam extending free from said second spaceable member.

4. In a module construction as defined in claim 3, said retainer means being further characterized by said second spaceable member being movable against said clamp portion of the spring cam after insertion to more firmly urge said second camming surface against said wall means.

* * * * *